US006152016A

United States Patent [19]

Bahr et al.

[11] Patent Number: 6,152,016

[45] Date of Patent: Nov. 28, 2000

[54] PISTON WITH CAST PASSAGES

[75] Inventors: Andreas Bahr, Toronto, Canada; Irvin Zwicker, Rochester, Mich.

[73] Assignee: DaimlerChrysler Corporation, Auburn Hills, Mich.

[21] Appl. No.: 09/240,263

[22] Filed: Jan. 29, 1999

[51] Int. Cl.[7] ..... F01B 31/10

[52] U.S. Cl. ..... 92/160; 92/208

[58] Field of Search ..... 92/160, 172, 208

[56] References Cited

U.S. PATENT DOCUMENTS

| | | | |
|---|---|---|---|
| 1,633,187 | 6/1927 | Norton . | |
| 1,959,648 | 5/1934 | Tandy | 29/156.5 |
| 3,413,897 | 12/1968 | Atkin | 92/186 |
| 4,599,936 | 7/1986 | Bedwell et al. | 92/228 |
| 4,656,711 | 4/1987 | Yagi et al. | 29/156.5 |
| 4,809,591 | 3/1989 | Rhodes et al. | 92/208 |
| 4,836,093 | 6/1989 | Wagner | 92/160 |
| 5,230,148 | 7/1993 | Leites et al. | 92/208 |
| 5,655,433 | 8/1997 | Santi | 92/208 |
| 5,778,533 | 7/1998 | Kemnitz | 29/888.049 |

*Primary Examiner*—Edward K. Look
*Assistant Examiner*—Hermes Rodriguez
*Attorney, Agent, or Firm*—Lawrence J. Shurupoff

[57] ABSTRACT

A piston is formed with one or more recesses or depressions on its underside as it is cast, molded or forged. The recesses are located adjacent the outer cylindrical wall of the piston head so that when a groove such as an oil ring groove is subsequently machined into the outer wall, the groove intersects and cuts into each recess. In this manner, oil drain ports are formed in the oil ring groove without the need for additional boring or cutting operations.

14 Claims, 2 Drawing Sheets

PISTON WITH CAST PASSAGES

BACKGROUND OF THE INVENTION

1. Field of the Invention

The present invention relates to pistons for internal combustion engines, pumps, compressors and other applications and particularly to cast or forged pistons having oil passages formed at least in part during molding.

2. Description of the Prior Developments

Pistons for use in internal combustion engines and other applications typically are formed with one or more circumferential grooves for receiving one or more piston rings. The grooves are generally formed by a separate machining operation after the piston has been cast or forged. In the case of the oil ring groove, additional machining is typically needed after the groove is formed in order to form drain holes which allow oil to flow through the piston groove to return to an oil sump.

In some cases, cast or forged pistons are subjected to additional machining in order to reduce the weight of the piston. Recesses or bores are machined in the piston, generally in the floor of the piston to remove material and reduce weight.

Although these prior pistons perform adequately, the additional drilling and boring of the oil drain holes adds to the cost of manufacture.

Accordingly, a need exists for a piston having oil drain holes formed in an oil ring groove in such a manner that supplemental machining such as drilling and boring is obviated.

SUMMARY OF THE INVENTION

The present invention has been developed to meet the needs noted above and therefore has as an object the provision of a piston having drain holes formed in an oil ring groove without drilling or boring.

Another object of the invention is the provision of such a piston which is particularly well suited to fabrication by semi-solid molding techniques as well as more conventional technologies such as gravity casting or forging.

Another object of the invention is to form, by casting or forging, recesses or undercuts in the floor or underside of a piston so as to reduce the weight of the piston.

These and other objects are met by the present invention which is directed to a piston having one or more recesses or undercuts formed in the bottom portion of the piston body. Each undercut or recess is positioned to extend upwardly to a point which intersects the location of a later formed oil ring groove which is subsequently machined around the circumference of the piston wall.

Accordingly, when the oil ring groove is radially cut into the circumference of the piston wall, an opening or flow passage is formed from the ring groove to the interior of the piston via the undercut. In this manner, oil collected by the oil ring can circulate freely in accordance with common practice.

These and other objects, features and advantages of the invention will become more apparent as the following description proceeds, especially when considered with the accompanying drawings.

DETAILED DESCRIPTION OF THE PREFERRED EMBODIMENTS

Figure 1:
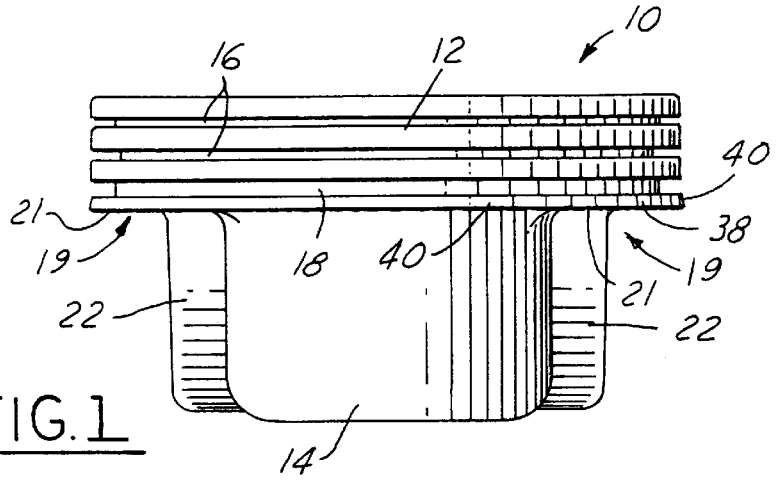
FIG. 1 is a front elevation view of a piston constructed in accordance with the invention.

The present invention will now be described in conjunction with the drawings, beginning with FIGS. 1, 2 and 3 which show, by way of example, a piston 10 of the type used in internal combustion engines. Piston 10 includes an upper cylindrical head portion 12 and a lower skirt portion 14.

The head portion 12 is formed with one or more circumferential grooves such as a pair of compression ring grooves 16 and an oil ring groove 18. Grooves 16 and 18 are typically formed by a turning operation such as a lathe cutting operation, after the head and skirt are formed. A pair of radially recessed or undercut arcuate reliefs 19 is formed beneath the head portion 12 so as to define a pair of somewhat C-shaped overhanging floor or ledge portions 21.

Figure 2:
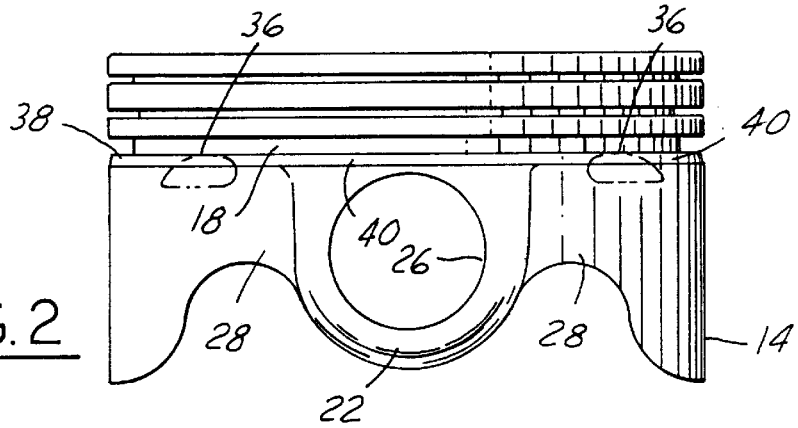
FIG. 2 is a side elevation view of FIG. 1.
Figure 3:
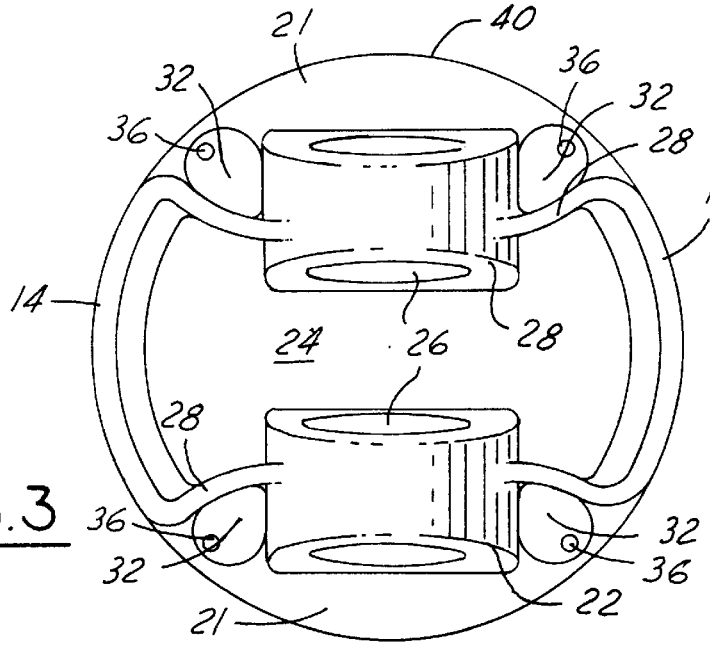
FIG. 3 is a bottom view of FIG. 1.

As seen in FIGS. 2 and 3, a pair of U-shaped wrist pin bosses 22 is formed adjacent ledges 21. The bosses extend downwardly from the underside or bottom surface 24 of the head portion 12. Each arched boss 22 is formed with a cylindrical bore 26 for receiving and supporting a common wrist pin.

Four curved (or optionally straight) axially-extending flanges or window walls 28 formed on the floor or bottom surface 24 interconnect the wrist pin bosses 22 with the skirts 14 to control elastic deformation of the skirts 14 caused by mechanical side forces.

At least one axially extending recess, relief, undercut or depression is formed in bottom surface 24 adjacent at least one of the grooves 16, 18. As seen in the examples of FIGS. 2 and 3, four symmetrically-spaced somewhat dome-shaped recesses 32 are formed in surface 24 and within ledges 21 on opposite ends of each boss 22, next to each window wall 28. The recesses 32 are preferably formed during the initial forming of piston 10. Piston 10 and recesses 32 can be formed by casting, molding, forging or semi-solid molding using, for example, aluminum alloy materials.

Due to the specific geometry and short axial length of the piston 10, relatively little alloy is used to form the piston. In this case, semi-solid molding is particularly effective in forming the piston using a heated billet which is molded in a semi-solid or highly viscous and easily deformable state.

The depth and location of each recess 32 is selected to intersect one or more of the grooves when and where the grooves are later formed. In this example, each recess 32 extends axially upwardly into the head portion 12 to a point coextensive with oil groove 18. When groove 18 is later cut into the cylindrical sidewall 34 of head portion 12, a portion of each recess is truncated, cut away or severed. This cutting, by lathe or other turning operation, creates an opening in the form of a drain port 36 which is formed in the floor 38 of oil groove 18 by the innermost tip or inner portion of each recess 32. Of course, other portions of recess 32 could be truncated or severed such as the sidewall of each recess 32.

In this manner, four drain ports 36 are formed in the radially-extending annular floor 38 of oil groove 18 to allow oil to flow through each drain port to an oil sump. This particular piston structure and forming method obviates the need for a separate drilling operation typically required to form oil return drain ports commonly referred to as "smoke holes". Drain ports 36 and recesses 32 also reduce the weight of the piston.

It should be noted that the lower annular or cylindrical circumferential wall or flange 40, also called the "fourth land", which extends downwardly toward the skirt portion 14 from groove 18 is continuous and unbroken so that wall 40 provides a 360° circumferential support to piston 10. The continuous and unbroken fourth land 40 also provides an uninterrupted cut of the ring land area 12 during machining, which improves the machinability of the piston. This structure should be contrasted with prior piston designs which provided for oil drainage from groove 18 by forming grooves, breaks, or cuts through the outer curved surface of wall 40 and/or skirt portion 14. This approach did not provide a continuous, unbroken 360° wall around the floor of groove 18 as does the present invention.

Figure 4:
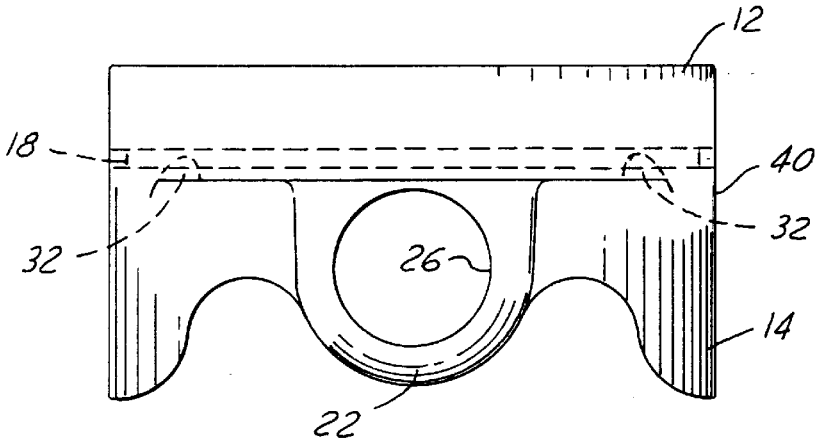
FIG. 4 is a view of a piston similar to that of FIG. 2 before the grooves are machined around the outer wall of the piston, and showing a piston groove and drain port recesses in dashed lines.
Figure 5:
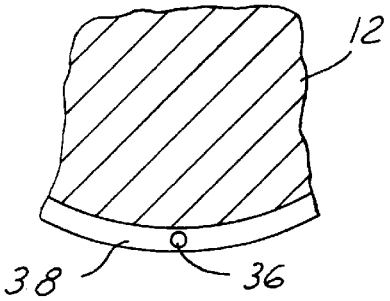
FIG. 5 is a top plan view, in fragment, of an oil groove and drain port formed in the piston of FIG. 4.

The relative positioning of the recesses 32 and oil ring groove 18 are shown in their as-cast condition in FIG. 4, before the oil groove 18 is cut and turned by a lathe. After turning, the drain port 36 is shown in FIG. 5 as a round hole formed through floor 38 of groove 18. Of course, any other shaped hole may be formed, depending on the shape of recesses 32 which can be formed with virtually any desired shape.

Figure 6:
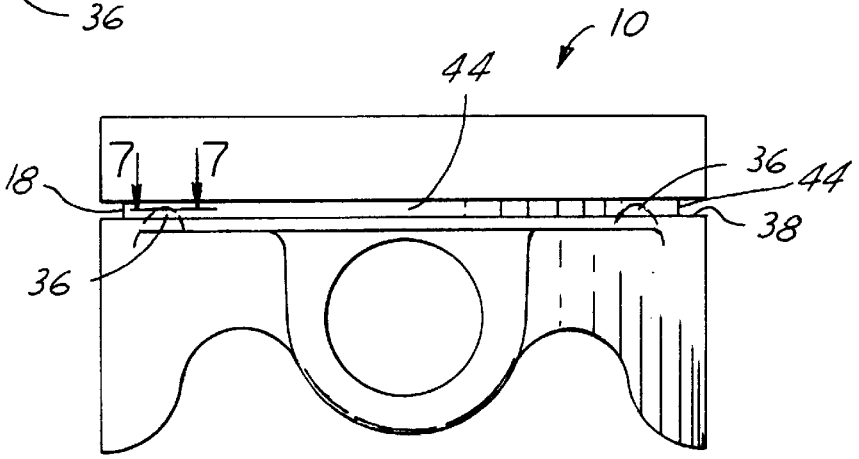
FIG. 6 is a view similar to FIG. 4 showing another embodiment of the invention.
Figure 7:
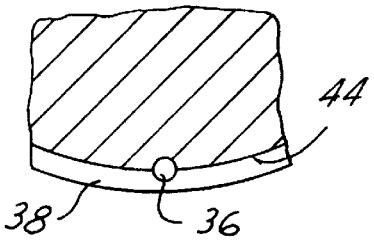
FIG. 7 is a view, in fragment, taken along line 7—7 of FIG. 6.

If desired, drain port 36 may also be formed in the radially-inner axially-extending wall 44 of groove 18, commonly known as the "groove root". This simply requires a corresponding alignment of recess 32 with groove 18 as shown in FIGS. 6 and 7 wherein the sidewall of recess 32 is truncated or cut away by groove 18.

It should be understood that while this invention has been discussed in connection with one particular example, those skilled in the art will appreciate that other modifications can be made without departing from the spirit of this invention after studying the specification, drawings, and the following claims.

What is claimed is:

1. A piston, comprising:

a head portion having a least one circumferential groove formed therein; and a bottom portion formed on said head portion and having at least one truncated recess formed therein, said groove cutting into and opening said recess so as to form a drain port.

2. The piston of claim 1, wherein said groove comprises an oil ring groove and wherein said drain port comprises an oil drain port.

3. The piston of claim 2, wherein said at least one recess comprises a plurality of recesses spaced around said groove.

4. The piston of claim 1, wherein said at least one recess comprises a cast recess.

5. The piston of claim 1, wherein said at least one recess comprises a forged recess.

6. The piston of claim 1, further comprising a pair of wrist pin bosses formed on said bottom portion.

7. The piston of claim 1, further comprising a skirt portion formed on said bottom portion.

8. The piston of claim 1, further comprising a plurality of axially-extending flanges formed on said bottom portion.

9. The piston of claim 7 further comprising a pair of skits formed on said piston and is respectively connected to one of said skirts.

10. The piston of claim 1, wherein said groove comprises an annular floor and further comprising a continuous circumferential wall surrounding said floor.

11. The piston of claim 10, wherein said annular floor comprises an oil groove flank portion.

12. The piston of claim 11, wherein said circumferential wall comprises a groove root.

13. A method of forming an oil drain port in a piston, wherein said method comprises:

forming a head portion on said piston;

forming at least one recess in said head portion by a molding operation; and machining a groove around said head portion and intersecting said recess, such that intersection of said groove and said recess forms said oil drain port.

14. The method of claim 13, wherein said molding operation comprises a semi-solid molding operation.

* * * * *